United States Patent [19]

Peppard

[11] 4,046,286

[45] Sept. 6, 1977

[54] TAMPER-PROOF BALL DISPENSING MECHANISM

[76] Inventor: Eugene Lee Peppard, 3537–46th Northeast, Steattle, Wash. 98105

[21] Appl. No.: 694,312

[22] Filed: June 9, 1976

[51] Int. Cl.[2] ..... B65H 33/14

[52] U.S. Cl. ..... 221/251; 221/276

[58] Field of Search ..... 194/55, DIG. 11; 221/11, 13, 14, 18, 19, 21, 251, 296, 298, 301, 276, 299; 273/3 R

[56] References Cited

U.S. PATENT DOCUMENTS

| | | | |
|---|---|---|---|
| 1,897,200 | 2/1933 | Klett | 221/301 X |
| 2,081,441 | 5/1937 | Willshaw et al. | 221/299 |
| 3,508,680 | 4/1970 | Ewald, Jr. et al. | 221/301 X |

*Primary Examiner*—Stanley H. Tollberg

[57] ABSTRACT

A tamper-proof ball dispensing mechanism for use in conjunction with game tables or the like. A supply of balls is held in a position remote from the player and a predetermined number of balls are dispensed by a mechanism which both measures the number of balls and dispenses them while simultaneously preventing dispensing of other balls and preventing operator interference with the dispensing mechanism. The balls are guided into a single line in a retaining, dispensing mechanism which is actuated by a coin operated plunger. The plunger pivots the dispensing/measuring device allowing the balls to fall through a tortuous path to a position where they may be removed by the player while temporarily preventing further removal from the storage area.

11 Claims, 8 Drawing Figures

TAMPER-PROOF BALL DISPENSING MECHANISM

BACKGROUND OF THE INVENTION

The advent of entertainment-type devices such as billiards, table soccer or the like, within areas such as taverns, waiting areas or the like, has greatly increased the need for accurate, safe, coin operated devices. Since it is obvious that these devices are to a large extent used in minimally supervised areas, they must not only be simple but they must also be of a construction not readily capable of being damaged or forced.

Also, since these devices are in minimally supervised areas and since it is necessary to keep the cost down, they will not be serviced on a frequent basis, they must be of a structure that will consistently operate as expected and designed. To have a device non-operative or only partially operative in an area of little supervision could be disastrous. It is for this reason that the devices addressed in this particular application and the devices which are in use in these common areas have a capacity of balls or the like which is greater than that minimally necessary to operate the machine. In the event that a ball is removed by vandalism or is broken, another one will replace the missing ball during the next normal operation and will not therefore inspire a player to damage the device because he felt cheated.

Many attempts have been made in the past to provide a fail-safe dispensing mechanism; however, these have tended to become complicated as a preventive measure and therefore have introduced the greater possibility of malfunctioning because of the number of elements involved.

Still other attempts made while addressing the problem have provided mechanisms which accurately measured the device or units being dispensed, were simple enough that the dispensing was a consistent function, but they were such that they could be easily tampered with, thus permitting an unscrupulous operator to empty the entire mechanism.

With the above-noted prior art and problems in mind, it is an object of the present invention to provide a failsafe dispensing mechanism for devices which are coin operated, a mechanism particularly designed such that a predetermined number of dispensed objects are accurately measured and dispensed in response to the deposit of the proper coinage.

Still a further object of the present invention is to provide a simple dispensing mechanism wherein the dispensing action is positive and direct and the mechanism is essentially incapable of being tampered by an unscrupulous operator.

Yet another object of the present invention is to provide a unique means for measuring and containing balls or the like prior to dispensing.

Still a further object of the present invention is to provide a unique and effective means for measuring a predetermined number of objects to be dispensed, store the objects until the appropriate dispensing time and then simulataneously dispense the measured objects and momentarily prevent the outflow of other of the objects from the adjacent storage area.

A still further object of the present invention is to provide a dispensing mechanism, adjustable to accommodate objects of varying size of a different number of objects without affecting the simple straightforward action of the dispensing mechanism.

Still another object of the present invention is to provide a mechanism for dispensing balls or the like wherein the dispensing mechanism mechanically, positively dispenses the correct number of objects.

DETAILED DESCRIPTION OF DRAWINGS

Figure 1:
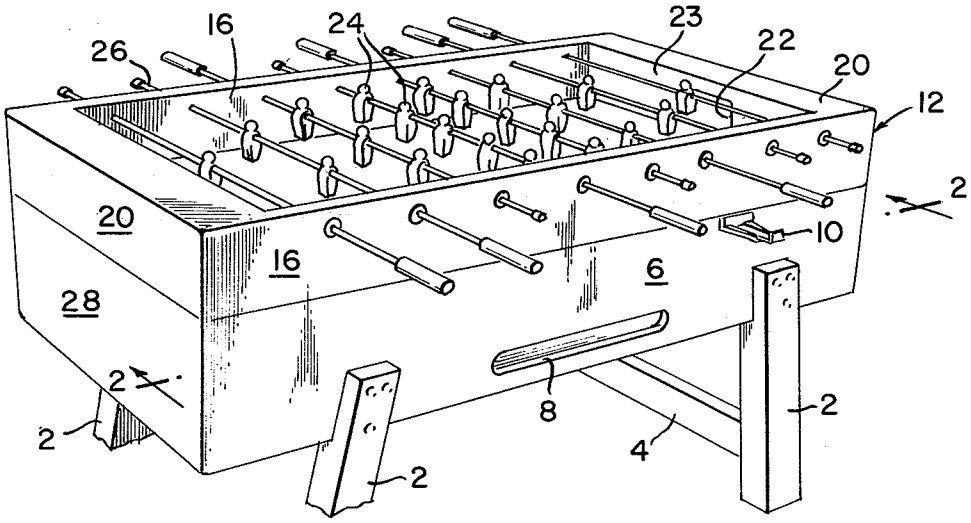
FIG. 1 is a perspective view showing table soccer equipment, a game for which the particular device is well suited.

In FIG. 1, a table soccer or foosball game table is depicted, a device to which the present invention is particularly well suited. As seen in this figure, the game table includes supporting legs 2 secured to a lower table portion 6 and including cross-braces 4. The lower table portion includes an access slot 8 for the balls provided with which to play.

A coin operated mechanism 10 located in the lower table portion operates the measuring/dispensing device as described hereinafter upon the deposit of proper coinage.

The upper part of the table 12 includes a playing surface 14, side rails 16 and end portions 20 including goals 22 located therein. The playing mechanisms include a plurality of simulated men 24 mounted on horizontal rods 26 having handles 28 extending out beyond the siderails 16. The players move the simulated men, contacting the ball and propelling the ball towards the opposent's goal. Obviously, the opposing player attempts to divert the ball from his goal and propel it toward the opposite goal.

Figure 2:
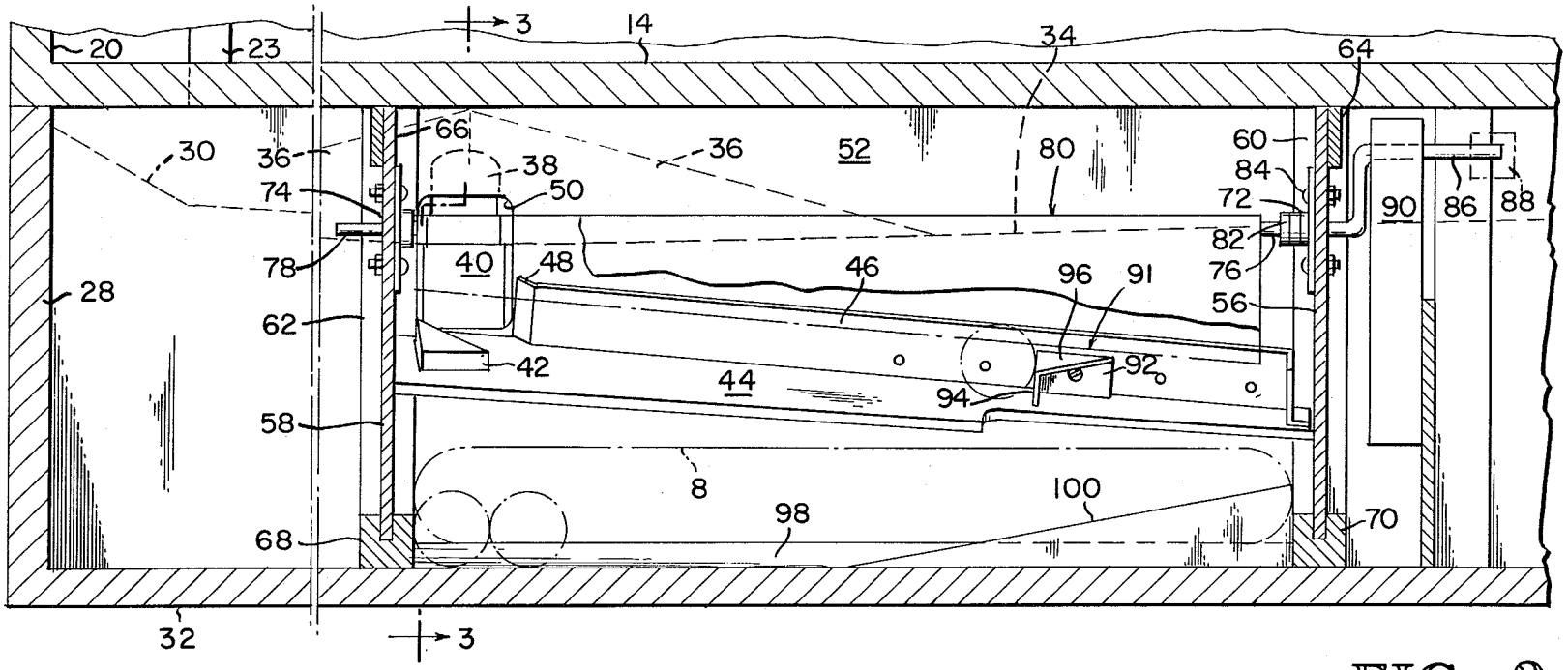
FIG. 2 is an elevational view taken along the lines 2—2 of FIG. 1, showing the internal ball dispensing structure.

As seen in FIG. 2, the lower portion of the table likewise includes an end wall 28. A ball passing through the goal 22, not shown in this view, would fall to the inclined floor 30. Inclined floor 30 abuts wall 28 at a position above the bottom 32 and urges the ball toward the opening which serves as a supply for the dispensing mechanism, as explained hereinafter. As seen in this view, the interior beneath the playing surface 14 includes the sloping floor 30, a sloping floor 34, and a pair of triangular shaped guide members 36 which meet along one edge spaced from the floor and having an opening 38 along the line of intersection. The slope of the floor 34 and the lines of intersection between the floor and the guide members 36 is such that balls in the storage area partially defined by the floor 34 are guided toward the opening 38. Opening 38 leads directly to an inclined ramp 40 which urges the balls toward a guide block 42 mounted upon a sloping floor 44 outside the storage area. Sloping floor 44 is inclined in both a direction downwardly out of the sheet when viewing FIG. 2 and to the right when viewing the same Figure. The particular slope of floor 44 assures that available balls completely fill the dispensing device and further are quickly and positively dispensed. A guide rail 46 is secured to floor 44 and forms the back wall for the dispensing mechanism. The uppermost portion of guide 46 includes an upwardly flexed end 48 which works in cooperation with guide block 42 to assure the movement of the balls to the dispensing position. As seen in the figure, the guide block 42 and the flexed portion 48 are located adjacent to and downstream from opening 50 in the wall 52 which separates the main storage chamber from the dispensing chamber.

The dispensing mechanism itself is mounted between two vertical walls 56 and 58 substantially perpendicular to wall 52, which are telescopically received within guides 60, 62 mounted to wall 52. The walls 56 and 58 include upper and lower reinforcement 64, 66, 68 and 70 and have pivotally mounted therethrough as at 72 and 74 substantially horizontally mounted rods 76, and 78 which, as will be explained in greater detail hereinafter, support the ball containing and dispensing element 80. The rod 76 which passes through the vertical wall 56 at 72 is held in a proper working location by means of filler washers 82 which serve to reduce wear and as spacers. It is to be noted that the wall 56 includes a reinforcing metal plate 84 surrounding the hole for increased life and durability. The rod 76 is formed into a bell-crank configuration where it extends beyond the wall 56 terminating in a substantially horizontal portion 86. Portion 86 of rod 76 is contacted by the pusher 88, shown in phantom, controlled by the coin operated mechanism. Portion 86 further reacts against stop mechanism 90 to control the relative movement of the dispensing mechanism in reaction to the coin operated mechanism. This prevents an overthrow.

The number of balls collected within the chute formed by guide 46 and element 80 is controlled by an adjustable stop member 91 having a back portion 92 for mounting against the guide 46, a forward essentially vertical portion 94 for stopping the downward movement of the balls and a top portion 96. A slanting floor 98 underlies the dispensing mechanism and a ramp or wedge 100 extends upwardly therefrom continuously urging the balls to a position readily available through the dispensing opening 8 phantomed in this view.

Figure 3:
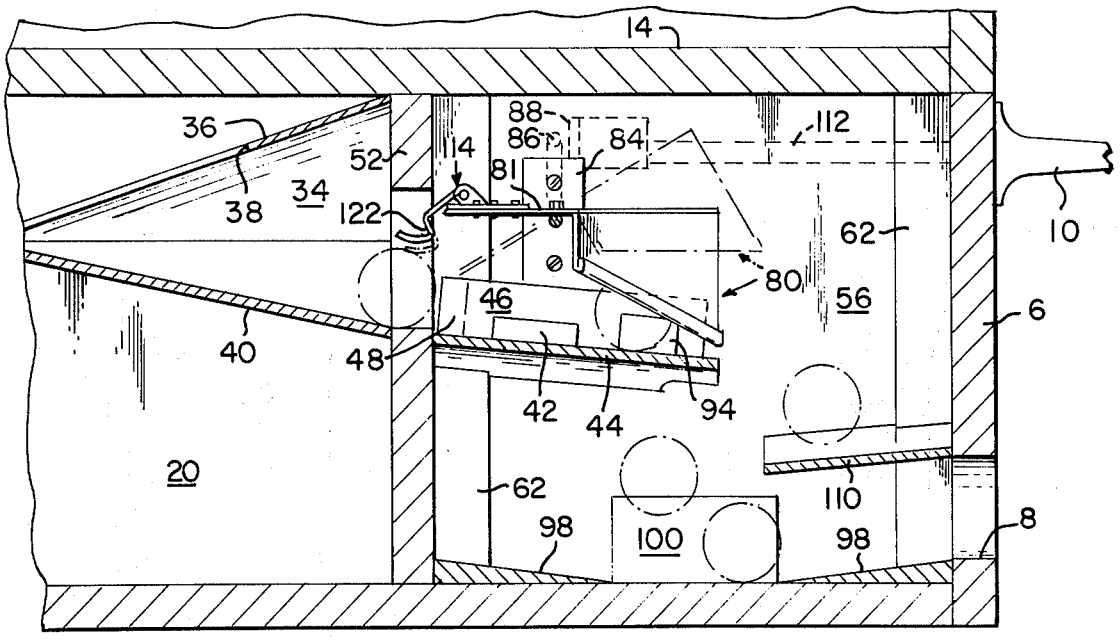
FIG. 3 is an elevational view taken along the lines 3—3 of FIG. 2, depicting the interrelationship of the dispensing and anti-tampering device.

Referring now to FIG. 3, the end-on view of the present invention, the various slopes and mechanisms are seen from a different perspective and further illustrates the tortuous path which the balls must follow. The balls leave the storage area where they are supported by floor 40 moving to the floor 44 wherein they are collected and counted, thence downwardly to sloping floor 110 and then to ramp 100 in floors 98. This path assures a consistent supply and inhibits tampering.

Also to be seen in this view is the rigid linking member 112 which extends from the coin operated mechanism 10 to the pusher 88 which, as noted above, contacts crank arm 86 thus pivoting the dispensing mechanism, generally designated 80, around the pivot point 76, raising the outer edge described hereinafter and allowing the balls to fall downwardly. It is also to be noted in this view that the dispensing mechanism 80 has a relatively horizontal upper surface 81 to which is hingedly mounted a ball control means 114 as to be described hereinafter. Suffice it to say at this point that when the dispensing element 80 is pivoted about its axis the ball control means prevents further balls from moving into the dispensing area.

Figure 4:
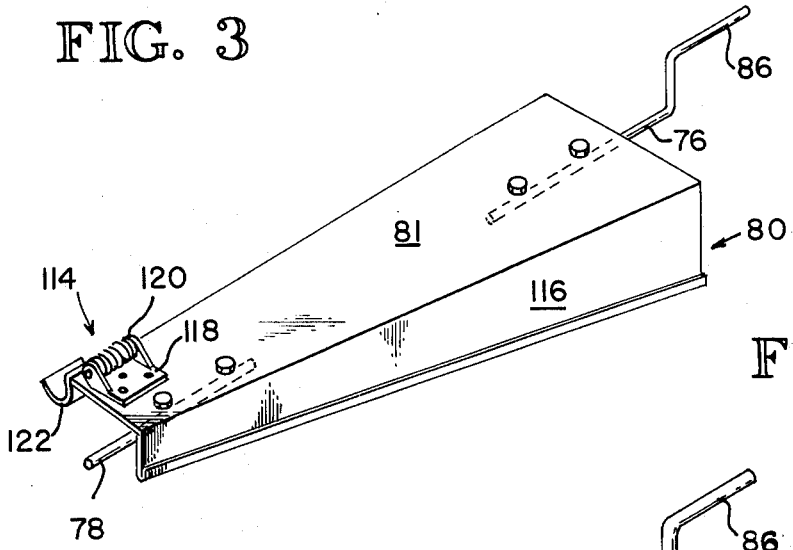
FIG. 4 is an enlarged view of one form of the dispensing mechanism.

Attention is now directed to FIG. 4 wherein the first embodiment of the dispensing mechanism is shown. As noted above, the ball dispensing mechanism is generally designated as 80- and includes a front face 116, a top planar surface 81, the crank rod including generally horizontal member 76 and crank arm 86 secured to the upper surface 81 and at the opposite end rod 78 substantially coaxial to member 76. As was seen in FIG. 3, the entire dispensing mechanism pivots about a line passing through line 78, 76 when dispensing the balls, in this instance by allowing the balls to follow the incline of the floor once front face 116 is lifted. At the after edge portion of the upper surface 81 there is mounted a spring-type hinge including a base plate 118 mounted to the upper surface 81, the hinge itself 120 and a downwardly extending shoe member 112. As explained hereinabove, the downwardly extending shoe member 122 does contact the ball when the dispensing is operational, retains the ball within the storage area thus preventing the inadvertent movement of the ball to the dispensing slot.

Figure 5:
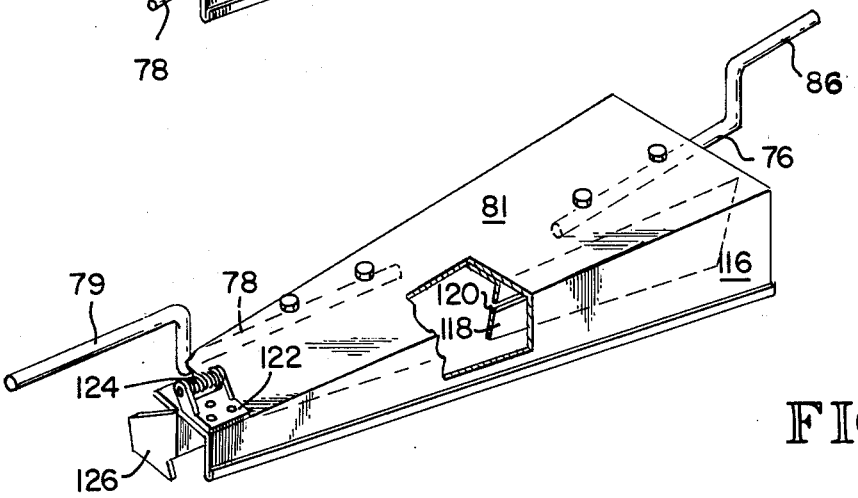
FIG. 5 is an enlarged view of another form of the dispensing mechanism.

Reference is now had to FIG. 5 which is another design of a dispensing mechanism operating on essentially the same principles and including a vertical rod 76 and crank arm 88 for contact by the pusher member as described hereinabove. At the opposite end of the upper portion 81 is another crank 79. This dispensing element also includes the front face 116 and a spaced wall 118 such that the balls are actively pushed from the shelf during the dispensing operation. Because of the placement of the walls 116 and 118 the center of pivot was moved to avoid contact between wall 118 and floor 44, thus the divergent extensions of the two cranks 76 and 78 and their attachments 79 and 88. Also to be noted in this view is a slot 120 in the wall 118 wherein an adjustable stop mechanism may be mounted. The ball control means for this embodiment whereby additional balls are not transmitted to the space between walls 116 and 118 during the dispensing process includes a spring-type hinge on a mounting plate 122. A knife-like element 126 moves between the balls forming a positive stop preventing the outward motion of further balls.

Figure 6:
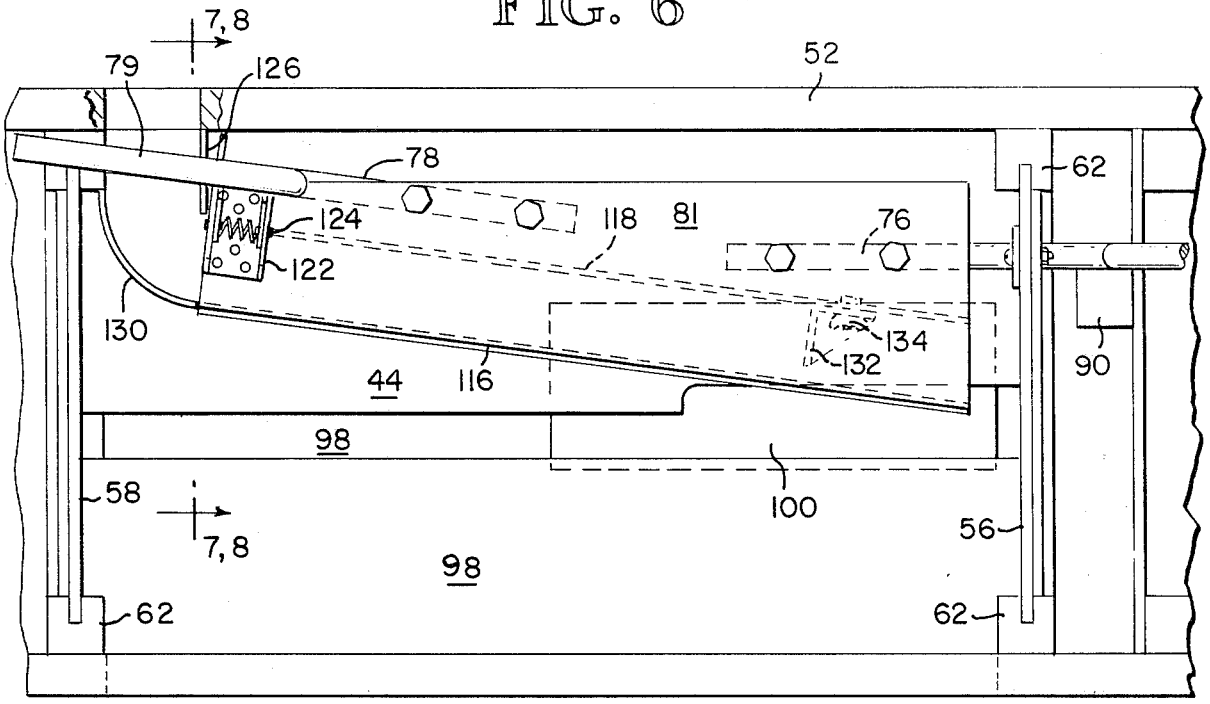
FIG. 6 is a plan view showing the dispensing mechanism as illustrated in FIG. 5 in position within the table soccer table.

Referring now to FIG. 6 it can be seen that in major aspects it is the same as structure shown in FIG. 2 with exception of the dispensing mechanism per se and therefore identical numerals will be used to designate the identical elements. As seen in this view, the different structure of the dispensing mechanism, as shown in FIG. 5, necessitated a slight change in the structure of the table itself. As seen in this view there is a guide element 130 which channels the balls into the area defined by walls 116 and 118. The ball control mechanism 126 serves as a stopping device when and only when the mechanism is dispensing. Also seen in this view, shown in phantom, is the adjustable stop element 130 which moves within slot 120 and is locked in position by means of wing nut 132.

Figure 7:
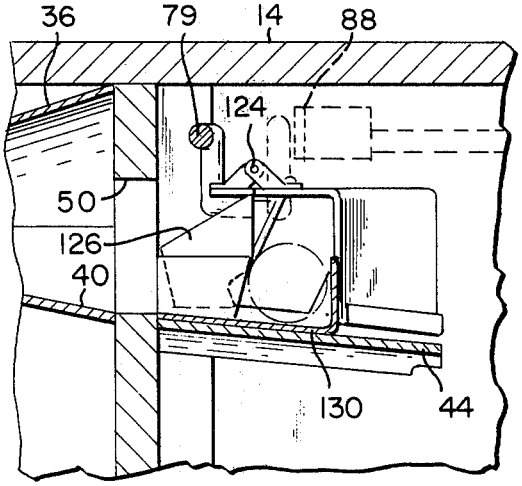
FIGS. 7 and 8 are end-views taken along lines 7–7 showing the dispensing mechanism of FIG. 5 in two positions during the dispensing operation.
Figure 8:
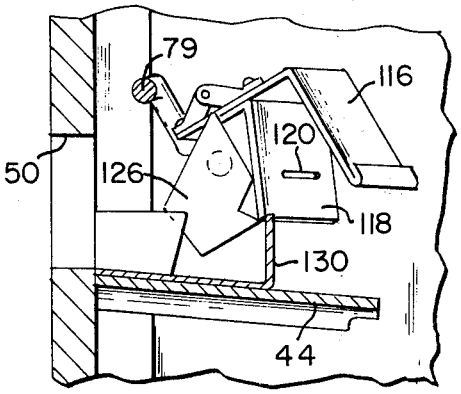

The operation of the dispensing mechanism as shown in FIGS. 5 and 6 is clearly depicted in FIGS. 7 and 8 and as is immediately obvious show the ball control element 126 in conjunction with wall 118 serves to positively force the balls outwardly from the floor 44 and simultaneously prevent the discharge of other balls.

As can thus be readily seen, the present invention and embodiments of dispensing mechanism provide a viable and tamper-proof means of dispensing a predetermined number of balls following the happening of a predetermined condition such as the insertion of the proper coinage.

The structure of the present inventive mechanism allows the table to serve as a storage for a large number of balls and yetprevents the unscrupulous from taking advantage of the fact that the environment wherein the table is in use is largely unattended.

The one embodiment, as readily perceived, relies upon the force of gravity to dispense the balls. An acceptable and yet slow moving operation is thus disclosed; however, the second device move positively dispenses the balls and simultaneously offers a more secure means of preventing the tampering with the mechanism.

What is claimed is:

1. A tamper proof dispensing mechanism for use in conjunction with game tables or the like comprising:

a first storage area inaccessible to the player to receive game elements ejected from the playing surface and store them prior to dispensing;

a combination measuring and dispensing apparatus adjacent the first storage area and inaccessible to the player, said measuring and dispensing apparatus interconnected with the first storage area and comprising a sloping floor member for supporting the playing pieces prior to dispensing and an elongated gate member including a downwardly extending side element running substantially the entire length of the gate member, said side element serving to both contain the game elements prior to dispensing, and to restrict the elements to a simple line along the gate member said gate member pivotable to permit the simultaneous dispensing of the playing pieces means preventing movement of playing pieces from the first storage area during the dispensing process;

means exterior of the table to actuate the measuring and dispensing apparatus, and a second storage area accessible to the player for holding the playing pieces prior to use.

2. A measuring and dispensing means as in claim 1, wherein the means responsive to a predetermined condition is a rigid element moved to operate the dispensing means following the insertion of a predetermined coinage.

3. A measuring and dispensing means as in claim 1 wherein the elongated gate member simultaneously releases the objects and positively dispenses them.

4. A measuring and dispensing means as in claim 1 wherein the means preventing movement from the first storage area is a spring biased fixture preventing outward movement of the objects.

5. A tamper proof dispensing mechanism as in claim 1 wherein the means preventing movement from the first storage area is spring biased and closes the interconnection between the storage area and the dispensing apparatus during the dispensing of the elements.

6. A measuring and dispensing means as in claim 3 wherein a pusher member, movable with the gate member simultaneously dispenses the objects.

7. In a game table, wherein a controlled number of playing pieces are to be selectively dispensed for use, a tamper proof dispensing apparatus comprising:

main storage means interior of the table, generally inaccessible to a player and including at least one inclined surface urging the playing pieces toward a dispensing mechanism, said storage means including playing piece receiving means whereby the pieces are automatically transferred to the main storage following completion of a phase of the game, secondary storage and dispensing means adjacent the main storage means but inaccessible to a player and interconnected with the main storage means by a restricted, selectively closed passageway, said secondary storage and dispensing means comprising a sloping floor portion, restrictive side portions and an adjustable end element whereby the number of playing pieces within the secondary storage and dispensing means can be accurately controlled, and an elongated gate member including a downwardly extending side element running substantially the entire length of the gate member, said side element serving to both contain the game elements prior to dispensing, and to restrict the elements to a single line along the gate member said gate member pivotable to permit the simultaneous dispensing of the game elements tertiary storage means, below said second storage means and accessible to a player, and operating mechanism, exterior of the table, responsive to a predetermined condition to move at least one side portion of the secondary storage means to allow all pieces to simultaneously move from the secondary storage means to the tertiary storage means while precluding pieces from moving from the main storage means to the secondary storage means.

8. A tamper proof dispensing means as in claim 7, wherein the operating mechanism simultaneously releases the objects and positively moves them to the tertiary storage means.

9. A tamper proof dispensing apparatus as in claim 7, wherein the means precluding the movement of pieces from the main storage means to the secondary storage means is a spring biased fixture blocking the interconnection between the main storage means and the secondary storage and dispensing means.

10. A tamper proof dispensing means comprising:

a storage area for the articles to be dispensed, dispensing means movable from a first storage position to a second dispensing position adjacent the storage area for receiving and aligning a predetermined number of the articles to be dispensed and simultaneously dispensing the articles, said dispensing means including a gate member pivotable about an axis which is approximately parallel to the single line of articles to be dispensed whereby the articles will be dispensed simultaneously and further including a member approximately parallel to the gate member and movable therewith whereby the articles are positively dispensed through the action of the member and, means preventing movement of the articles from the storage area when the dispensing means is in its second position.

11. A tamper proof dispensing means comprising:

a storage area for the articles to be dispensed, dispensing means movable from a first storage position to a second dispensing position adjacent the storage area for receiving and aligning a predetermined number of the articles to be dispensed and simultaneously dispensing the articles, said dispensing means including a gate member pivotable about an axis which is approximately parallel to the single line of articles to be dispensed whereby the articles will be dispensed simultaneously and, spring biased means preventing movement of the articles from the storage area by closing the passage from the storage area when the dispensing means is in its second position.

* * * * *